United States Patent [19]

Kessler et al.

[11] 4,413,748

[45] Nov. 8, 1983

[54] PINCH CAP

[75] Inventors: Milton Kessler, Youngstown; Myron E. Ullman, Canfield, both of Ohio

[73] Assignee: Kessler Products Co., Inc., Youngstown, Ohio

[21] Appl. No.: 400,633

[22] Filed: Jul. 22, 1982

[51] Int. Cl.[3] ..... B65D 43/04

[52] U.S. Cl. ..... 220/281; 220/94 A; 220/DIG. 19; 220/307; 220/366

[58] Field of Search ..... 220/281, 307, 94 A, 220/366, DIG. 19; 215/211, 224, 307

[56] References Cited

U.S. PATENT DOCUMENTS

| | | | |
|---|---|---|---|
| Re. 25,906 | 11/1965 | Livingstone . | |
| 815,062 | 3/1906 | Bennett . | |
| 2,436,711 | 11/1949 | Harris . | |
| 2,723,041 | 11/1955 | Hart-Still . | |
| 2,913,140 | 11/1959 | Vuillemenot | 220/94 A |
| 3,171,458 | 3/1965 | Strong . | |
| 3,244,308 | 4/1966 | Esposito, Jr. . | |
| 3,529,744 | 9/1970 | Johnson et al. | 220/94 A |
| 3,622,028 | 11/1971 | Lohrer . | |
| 4,027,776 | 6/1977 | Douglas | 220/281 |
| 4,083,468 | 4/1978 | Batchelor . | |
| 4,094,429 | 6/1978 | Urbin . | |
| 4,254,889 | 3/1981 | Jacobs . | |
| 4,303,171 | 12/1981 | Schremmer . | |
| 4,315,578 | 2/1982 | Ludwig, Jr. . | |
| 4,334,632 | 6/1982 | Watanabe | 220/307 |
| 4,360,119 | 11/1982 | Olive | 220/94 A |

*Primary Examiner*—George T. Hall

*Attorney, Agent, or Firm*—David A. Burge

[57] ABSTRACT

A pinch cap has a top wall with edge portions which form a circumferentially-extending rim. A pair of spaced, D-shaped, finger-receiving wells open through the top wall. The wells are formed by curved and straight side walls which depend from the top wall, and by a pair of D-shaped bottom walls. Locking formations are provided on the outer faces of the curved side walls for holding the cap in place in a container opening. During insertion of the cap into a container opening, the locking formations engage portions of the container located at spaced positions around the container opening and cause the normal configuration of the cap to distort briefly as is needed to permit the locking formations to pass through the container opening. Removal of the cap from the container opening is effected by pinching the flat side walls toward each other to distort the normal configuration of the cap sufficiently to release the locking formations from retaining engagement with the container, whereafter the cap is lifted out of the container opening. Venting grooves may be provided in the curved side walls and in the underside of the rim to permit the escape of gases through the container opening.

30 Claims, 14 Drawing Figures

PINCH CAP

BACKGROUND OF THE INVENTION

1. Field of the Invention

The present invention relates to container closures, and, more particularly, to a pinch-to-release cap for closing a container opening.

2. Prior Art

Caustic substances and other materials in granular form are sold as household products for cleaning blockages from drains, and for other household uses. Containers for these granular materials must be provided with closures which are easy to install and remove, and which will securely retain the granular materials within their containers. Particularly where caustic substances are involved, closures must be operable with sufficient ease to assure that container contents are not inadvertently spilled or otherwise discharged during closure installation or removal.

It is desirable that closures for caustic material containers be "childproof" in the sense that at least two distinct types of movements must be performed in proper sequence to effect closure removal. Furthermore, it is desirable that such closures have relatively simple configurations which can be molded easily from relatively inexpensive plastics materials. Additionally, it is desirable that such closures be characterized by smooth lines which provide an aesthetically pleasing appearance.

Some granular caustic materials react with air and emit small quantities of gas which, if permitted to build up without relief, will cause container rupture or dislodging of the closure. Accordingly, in some instances there is a need to provide closures which will prevent pressure buildups by venting gases from within a container.

Previously proposed container closure caps have not adequately addressed the foregoing needs. Many are either undesirably difficult to operate, or they close insecurely. Many are of unduly complex configuration, have unattractive appearances, and/or are undesirably expensive to mold from plastics material. Most fail to address the need for a gas venting capability.

SUMMARY OF THE INVENTION

The present invention overcomes the foregoing and other drawbacks of prior proposals by providing a novel and improved pinch cap for releasably closing a container opening.

In accordance with the preferred practice of the present invention, a one-piece pinch cap formed from plastics material has a top wall with edge portions which form a circumferentially-extending rim. A pair of spaced, finger-receiving wells open through the top wall. The wells are formed by side walls which depend from the top wall, and by a pair of bottom walls. Locking formations are provided on the outer faces of selected ones of the side walls for holding the cap in place in a container opening. During insertion of the cap into a container opening, the locking formations engage portions of the container located at separate positions around the container opening and cause the normal configuration of the cap to distort briefly as is needed to permit the locking formations to pass through the container opening. Removal of the cap from the container opening is effected by pinching juxtaposed ones of the side walls toward each other to distort the normal configuration of the cap sufficiently to release the locking formations from retaining engagement with the container, whereafter the cap is lifted out of the container opening.

The locking formations may take a variety of configurations. In one embodiment they include rib segments which extend along the side walls paralleling the plane of the top wall. In another embodiment the locking formations include wedge-shaped ribs which extend in planes that are transverse to the plane of the top wall.

Venting passages may be provided in the side walls and in the underside of the rim to permit the escape of gases through the container opening.

BRIEF DESCRIPTION OF THE DRAWINGS

The foregoing and other features of the present invention will be better understood by referring to the description of the preferred embodiment and claims which follow, taken together with the accompanying drawings, wherein:

DESCRIPTION OF THE PREFERRED EMBODIMENT

Figure 1:
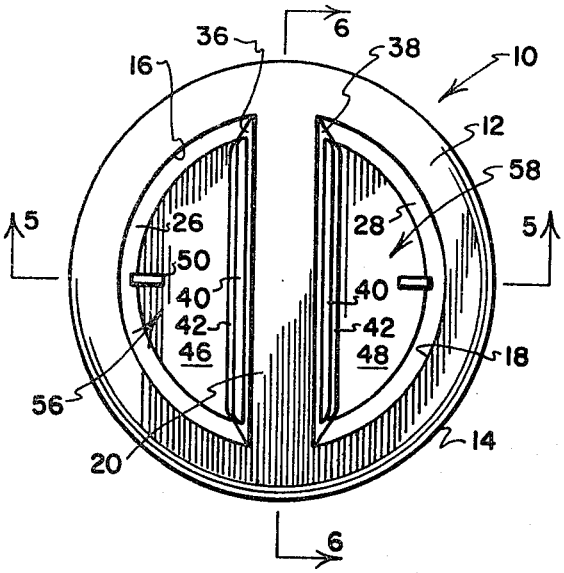
FIG. 1 is a top plan view of one embodiment of a pinch cap incorporation features of the present invention.

Referring to FIGS. 1–6, a pinch cap embodying the preferred practice of the present invention is indicated generally by the numeral 10. The cap 10 has a top wall 12 with edge portions which form a downwardly-turned, circumferentially-extending rim 14. A pair of D-shaped openings 16, 18 are formed through the top wall 12. The top wall 12 has a bar 20 of material which extends between flat sides of the openings 16, 18.

The cap 10 has a curved side wall 22 which makes a generally circular line of connection with the top wall 12 at a location which is inset from the circular outer edge of the rim 14. The side wall 22 has a pair of portions 24 which depend from the top wall 12 for relatively short distances at locations near opposite ends of the bar 20, and relatively longer depending portions 26, 28 which join the top wall 12 along the curved sides of the D-shaped openings 16, 18. As will be explained, the portions 24 are preferably inset from the rim 14 to a slightly greater degree than the portions 26, 28 to assist in providing a pair of gas vent passages for venting gases from within a container which is closed by the cap 10.

Figure 5:
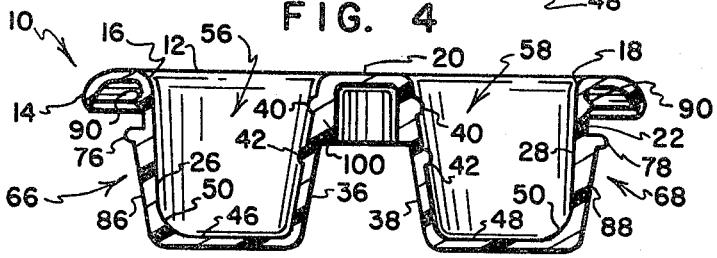
FIGS. 5 and 6 are sectional views as seen from planes indicated by lines 5—5 and 6—6 in FIG. 1.

The cap 10 has a pair of substantially flat walls 36, 38 which join the top wall 12 along opposite sides of the bar 20, i.e., along the straight sides of the D-shaped openings 16, 18. Ribs 40, 42 are formed on the flat walls 36, 38 to facilitate the gripping of these walls by one's fingers to effect a pinch-to-remove action, as will be described. A pair of D-shaped bottom walls 46, 48 join with the curved side walls 26, 28 and with the flat walls 36, 38 to define a pair of upwardly-opening, D-shaped, finger-receiving wells 56, 58 located on opposite sides of the bar 20. A pair of rigidifying, generally triangular-shaped ribs 50 connect the bottom and side walls 46, 48 and 26, 28, as is best seen in FIGS. 1 and 5.

Figure 7:
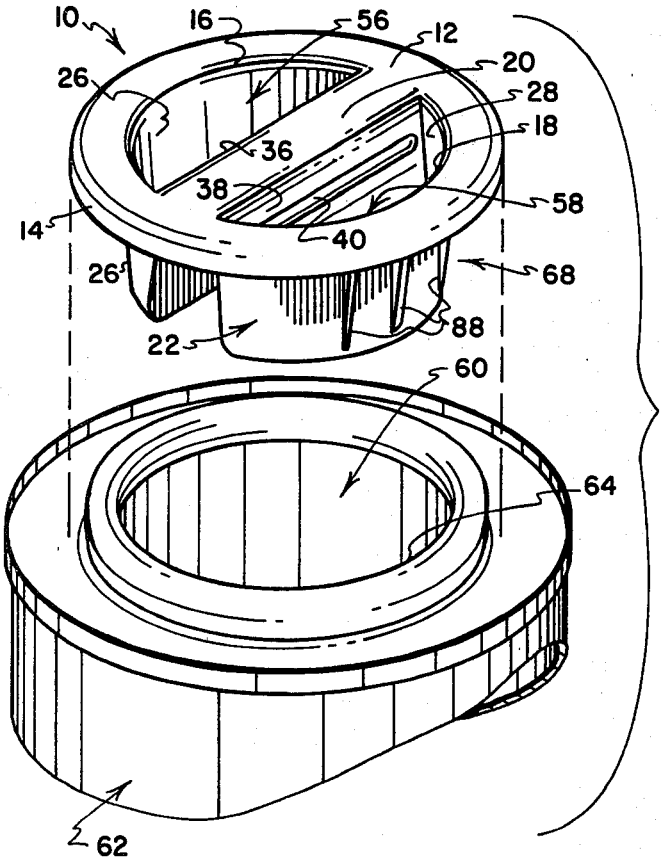
FIG. 7 is a perspective view of the pinch cap of FIG. 1 and a container end portion which has an opening that may be closed by the cap.
Figure 9:
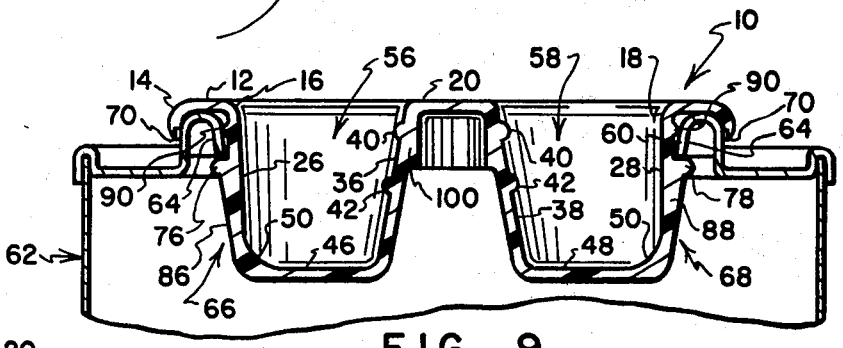
FIG. 9 is a sectional view, on an enlarged scale, as seen from a plane indicated by a line 9—9 in FIG. 8.
Figure 8:
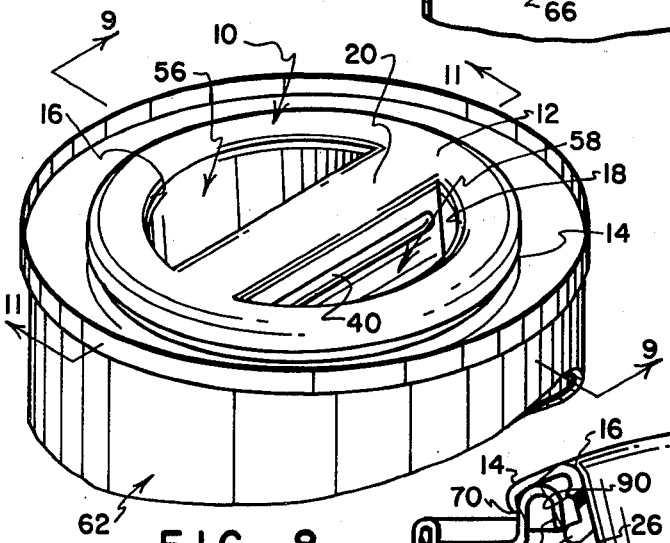
FIG. 8 is a perspective view showing the pinch cap of FIG. 1 in position closing the container opening.
Figure 11:
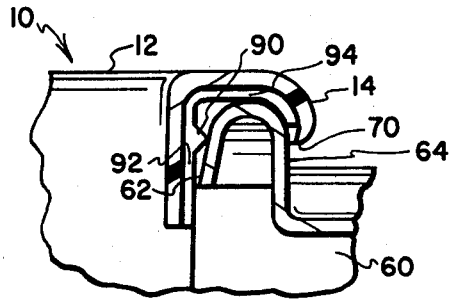
FIG. 11 is a sectional view, on an enlarged scale, as seen from a plane indicated by a line 11—11 in FIG. 8.

Referring to FIGS. 7–9, the cap 10 is insertable into a circular opening 60 formed in a container 62 to releasably close the opening 60. The container 62 has an upstanding neck 64. Referring to FIG. 11, the rim 14 has a pointed edge 70 which is configured to provide a rounded outer surface that is not easily engaged by one's fingernail, whereby the likelihood of a person being able to grasp the rim 14 to remove the cap 10 from the container 62 is rendered minimal.

Figure 3:
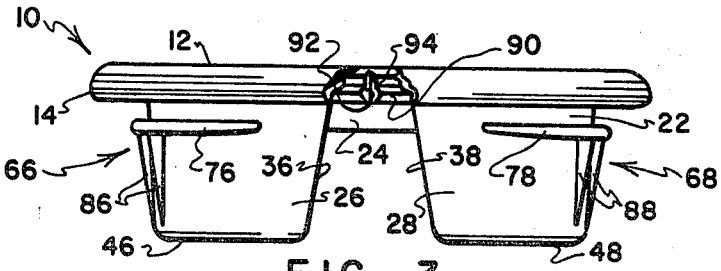
FIGS. 3 and 4 are side elevational views thereof, on an enlarged scale, as seen from planes indicated by lines 3—3 and 4—4 in FIG. 2.
Figure 4:
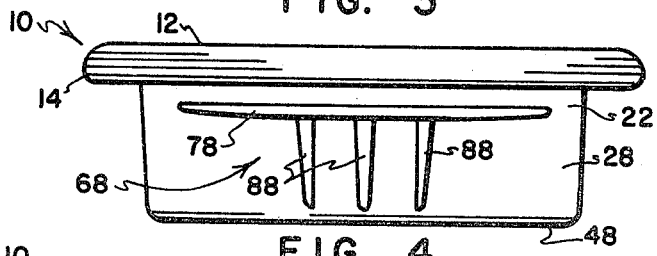

Referring to FIGS. 3 and 4 in conjunction with FIGS. 7–9, the cap 10 carries locking formations, indicated generally by the numerals 66, 68, which are engageable with portions of the container neck 64 which are located on opposite sides of the opening 60 for retaining the cap 10 in place in the opening 60. The locking formations 66, 68 include a pair of locking ribs 76, 78 which project radially outwardly from the curved side walls 26, 28, respectively, and sets of tapered guide projections 86, 88 which connect with the locking ribs 76, 78 and depend axially along the curved side walls 26, 28, respectively. The locking ribs 76, 78 taper in cross section along their lengths and are configured and positioned to underlie and engage the container portions 62, 64 to hold the cap 10 in place in the container opening 60. Ends of the locking ribs 76, 78 diminish in cross section to join smoothly with the curved side walls 26, 28. The guide projections 86, 88 serve to distort the normal configuration of the cap 10 as the cap 10 is inserted into the opening 60 to permit the locking ribs 76, 78 to pass through the opening 60.

Figure 10:
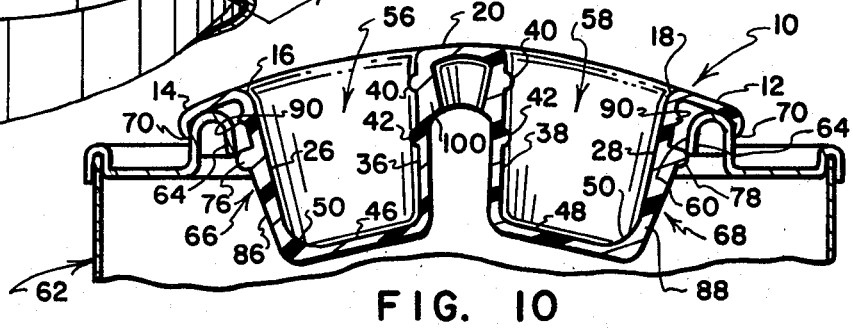
FIG. 10 is a sectional view similar to FIG. 9 showing how the normal configuration of the pinch cap of FIG. 1 may be distorted briefly to effect release and removal of the cap from the container opening.

The cap 10 may be removed from the opening 60 by inserting one's fingers into the wells 56, 58 and pinching the flat side walls 36, 38 toward each other, as is shown in FIG. 10. The cap 10 is resiliently bendable about the general region of the junctures of the flat sides walls 36, 38 and the bar 20 to permit the structures of the wells 56, 58 to move relatively toward and away from each other. As the flat side walls 36, 38 move toward each other, the normal configuration of the cap 10 is distorted sufficiently to release the locking ribs 76, 78 from retaining engagement with the container portions 64, whereafter the cap 10 may be lifted out of the opening 60. Once the pinching pressure is released, the memory of the plastics material from which the cap 10 is formed functions to return the cap 10 to its normal configuration.

Figure 6:
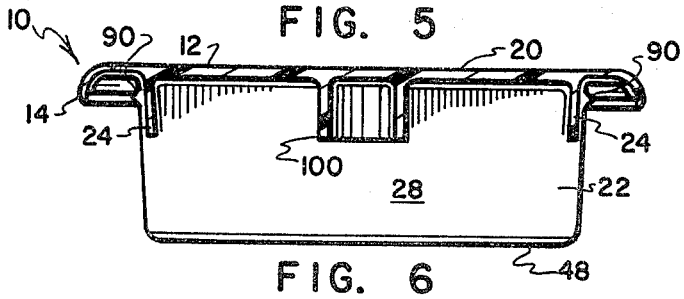

Referring to FIGS. 5 and 6, a circumferentially-extending V-shaped rib 90 is formed on the curved side wall 22. The V-shaped rib 90 is located radially inwardly from the downwardly-turned rim 14, and serves to form a seal with such portions of the container 62 as define the container opening, as shown in FIG. 9. Referring to FIGS. 3 and 11, the rib 90 may be interrupted by venting grooves 92 which are formed in the curved side wall portions 24. The grooves 92 also have portions 94 which are formed in the underside of the rim 14, as is best seen in FIG. 11.

Figure 2:
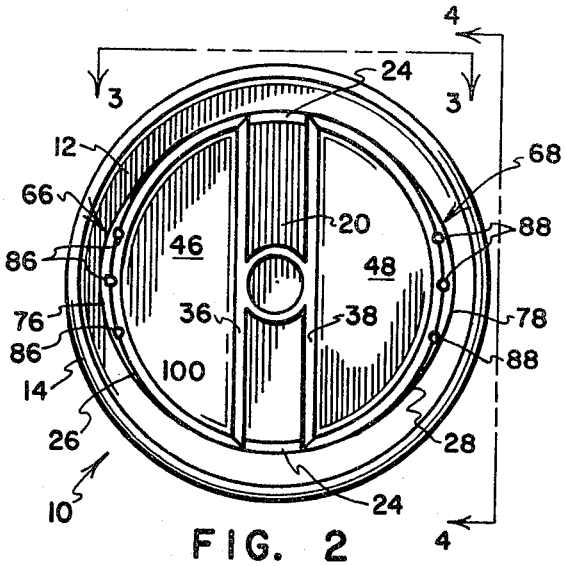
FIG. 2 is a bottom plan view thereof.

Referring to FIG. 2, a ring of material 100 is formed integrally with and depends from the top wall 12 into the space between the flat side walls 36, 38. The ring 100 engages the flat side walls 36, 38 and cooperates with the side wall portions 24 to maintain the normal spaced relationship between the flat side walls 36, 38. When the normal configuration of the cap 10 is distorted to effect its insertion into or removal from the container opening 60, the ring 100 and the side wall portions 24 are distorted by movement of the flat side walls 36, 38 toward each other, as is shown in FIG. 10. As the ring 100 and the side wall portions 24 return to their normal configurations, the memory of the plastics material which forms the ring 100 and the side wall portions assists in re-establishing the normal spacing between the flat side walls 36, 38 as the cap 10 returns to its normal configuration.

The cap 10 is preferably formed as a one-piece molded structure, utilizing a resilient thermoplastics material such as polyethylene or polypropylene or the like which does not react with such caustic substances as may be carried by the container 62.

Figure 12:
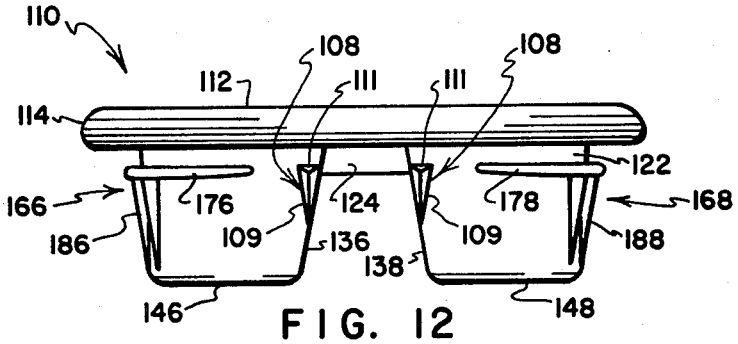
FIGS. 12 and 13 are side elevational views similar to FIGS. 3 and 4 of an alternate, preferred form of pinch cap which incorporates features of the present invention; and, FIG. 14 is a sectional view, on an enlarged scale, showing a portion of the cap of FIGS. 12 and 13 installed in a container opening.
Figure 13:
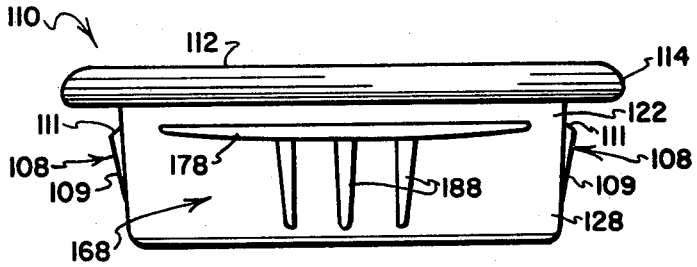

Referring to FIGS. 12 and 13, an alternate, preferred embodiment of pinch cap is indicated generally by the numeral 110. The cap 110 is identical to the cap 10 in all respects except for the inclusion of additional locking ribs 108 thereon. Inasmuch as the cap 110 includes all of the features of the cap 10, such features of the cap 110 as correspond identically to features of the cap 10 are labeled in the drawings with numerals which differ by a magnitude of one hundred, and need not be further described. By way of example, corresponding curved side wall portions of the caps 10 and 110 are indicated by numerals 26, 38 and 126, 128, respectively. Similarly, flat walls 36, 38 of the cap 10 have corresponding features in the form of flat walls 136, 138 on the cap 110.

Figure 14:
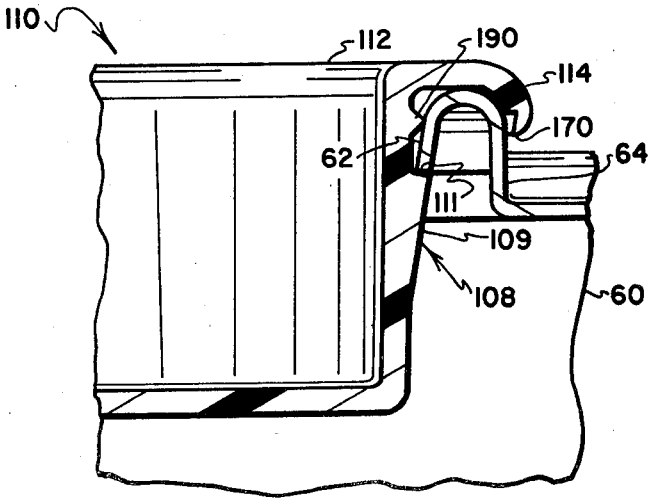

The locking ribs 108 are identical one with another, and are of generally triangular or wedge shape, as is illustrated in FIG. 14. The ribs 108 each have a tapered lower portion 109 which is configured to perform a wedging function to temporarily deform the cap 110 during its insertion into a container opening so that the lower portions 109 of the ribs 108 can pass through the container opening. The ribs 108 each have a tapered upper portion 111 which engages and partially underlies portions of the container at spaced locations around a container opening to assist in retaining the cap 110 in a position closing the container opening.

When the cap 110 is "pinched" to deform it for removal (in the manner in which the cap 10 is shown deformed in FIG. 10), the locking ribs 108 move sufficiently inwardly with respect to the container opening to release their engagement with the container so that the cap 110 can be lifted out of the container opening. While the locking ribs 108 have been illustrated in the drawings as being utilized on a cap 110 together with locking formations 166, 168 (which are identical to the locking formations 66, 68), it will be understood that the locking ribs 108 may be used alone, i.e., without being accompanied by the locking formations 166, 168.

While such orientation words as "top," "bottom," "upward," "downward" and the like are utilized herein, it will be understood that the cap of the present invention may be positioned in attitudes different from those described and illustrated. Accordingly, it will be understood that such orientation words as are utilized herein are intended to facilitate an understanding of the relative orientation of various components and are not to be construed as limiting.

Although the invention has been described in its preferred form with a certain degree of particularity, it is understood that the present disclosure of the preferred form has been made only by way of example and that numerous changes in the details of construction may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A pinch cap for insertion into a container opening to releasably close the opening, comprising:

(a) a top wall with edge portions which form a rim having a size which is greater than that of a container opening that is to be closed by the cap, the rim being configured to overlie container portions which surround the container opening;

(b) side wall portions which depend from the top wall at locations inset from the rim, the side wall portions having shapes which conform substantially to the shape of at least parts of the container opening, and being configured to permit the side wall portions to be inserted into the container opening;

(c) locking means carried on the side wall portions and projecting outwardly therefrom for engaging the container as the cap is inserted into the container opening, and for deforming the normal configuration of the cap sufficiently to permit at least selected portions of the locking means to be inserted through the container opening as the cap is inserted, the selected portions being configured to underlie and engage such container portions as define the container opening for retaining the cap in a position closing the container opening;

(d) the cap being formed as a one-piece, resiliently deformable structure molded from resilient plastics material which has a memory that tends to return the cap to its normal molded configuration if the cap has been deformed, and having a pair of spaced portions which are movable relatively toward and away from each other during cap deformation; and, (e) formation means including a pair of finger-receiving wells which open upwardly through the top wall at spaced locations, with each of the wells being connected to a separate one of the spaced, relatively movable portions for providing access thereto to enable the spaced, relatively movable portions to be gripped and pinched together to deform the normal configuration of the cap sufficiently to release the selected portions of the locking means from engagement with the container to permit the cap to be removed from the container opening.

2. The pinch cap of claim 1, wherein:

(a) the top wall has a generally round configuration with the rim defining its circumference;

(b) the side wall portions comprise portions of a generally round, substantially continuous side wall which depends from the top wall at a location spaced radially inwardly from the rim; and, (c) the finger-receiving wells are formed, at least in part, by portions of the side wall.

3. The pinch cap of claim 2 wherein the container has a neck which surrounds the container opening, and the rim defines a downwardly-turned edge surrounding the top wall, said edge being tapered and configured to closely engage the container neck.

4. The pinch cap of claim 1 wherein:

(a) the top wall includes an elongate, bar-like member which separates the finger-receiving wells; and, (b) a pair of substantially flat walls depend from opposite sides of the bar-like member and join with the side wall portions to define at least parts of the finger-receiving wells.

5. The pinch cap of claim 4 wherein the side wall portions include a pair of wall segments which are located near opposite ends of the bar-like member, and which extend between and connect the flat walls for urging the flat walls relatively away from each other to assist the cap in maintaining and recovering its normal molded configuration.

6. The pinch cap of claim 4 wherein a generally annular formation depends from the underside of the bar-like member into the space between the flat walls for urging the flat walls relatively away from each other to assist the cap in maintaining and recovering its normal configuration.

7. The pinch cap of claim 1 wherein the locking means includes a plurality of rib-like projections carried on the side wall portions.

8. The pinch cap of claim 7 wherein the top wall has a central portion which is generally flat, and the rib-like projections include rib segments which extend substantially parallel to the plane of the flat central portion of the top wall.

9. The pinch cap of claim 8 wherein the rib-like projections include tapered guide formations which connect with the rib portions and depend therefrom along the side wall portions in directions substantially transverse to the plane of the flat central portion of the top wall.

10. The pinch cap of claim 7 wherein the rib-like projections include tapered rib portions which are inclined relative to the plane of the flat central portion of the top wall.

11. The pinch cap of claim 10 wherein the tapered rib portions are located on the side wall portions in proximity to where the flat walls join the side wall portions.

12. The pinch cap of claim 1 additionally including grip-enhancing formation means provided on the relatively movable portions and facing into the finger-receiving wells to facilitate one's gripping the relatively movable portions.

13. The pinch cap of claim 1 wherein the formation means include bottom walls which join with the side wall portions to define portions of the finger-receiving wells.

14. The pinch cap of claim 13 additionally including rigidifying means connecting with the bottom walls and their associated side wall portions to rigidify the junctures between the bottom walls and the side wall portions.

15. The pinch cap of claim 1 additionally including vent formation means extending along the side wall portions and along the underside of the rim to vent gases through a container opening which is closed by the cap.

16. A pinch cap for insertion into a round opening of a container to releasably close the round opening, comprising:

(a) a generally round, substantially flat top wall with edge portions which form a circumferentially-extending rim having a size which is greater than that of a round container opening that is to be closed by the cap, the rim being configured to overlie container portions which surround the round container opening;

(b) curved side wall portions which depend from the top wall at locations inset from the rim, the curved side wall portions being configured to extent in close proximity to such container portions as define the round container opening;

(c) locking means carried on the side wall portions and projecting radially outwardly therefrom for engaging such portions of the container as define the container opening as the cap is inserted into the container opening, and for deforming the normal configuration of the cap sufficiently to permit at least selected portions of the locking means to be inserted through the container opening as the cap is inserted, the selected portions being configured to underlie and engage such container portions as define the container opening for retaining the cap in a position closing the container opening;

(d) the cap being formed as a one-piece, resiliently deformable structure molded from resilient plastics material which has a memory that tends to return the cap to its normal molded configuration if the cap has been deformed, and having a pair of spaced portions which are movable relatively toward and away from each other during cap deformation; and, (e) formation means including a pair of generally D-shaped finger-receiving wells which open upwardly through the top wall at spaced locations, with each of the wells being connected to a separate one of the spaced, relatively movable portions for providing access thereto to enable the spaced, relatively movable portions to be gripped and pinched together to deform the normal configuration of the cap sufficiently to release the selected portions of the locking means from engagement with the container to permit the cap to be removed from the container opening.

17. The pinch cap of claim 16, wherein the finger-receiving wells are formed, at least in part, by the curved side wall portions.

18. The pinch cap of claim 16 wherein:

(a) the top wall includes an elongate, bar-like member which separates the D-shaped finger-receiving wells; and, (b) a pair of substantially flat walls depend from opposite sides of the bar-like member and join with the curved side wall portions to define at least parts of the finger-receiving wells.

19. The pinch cap of claim 18 wherein the curved side wall portions include a pair of wall segments which are located near opposite ends of the bar-like member, and which extend between and connect the flat walls for urging the flat walls relatively away from each other to assist the cap in maintaining and recovering its normal molded configuration.

20. The pinch cap of claim 19 additionally including vent formation means extending along the pair of wall segments and along the underside of the rim to vent gases through a container opening which is closed by the cap.

21. The pinch cap of claim 18 wherein an annular formation of material formed integrally with the top wall depends from the underside of the bar-like member into the space between the flat walls for urging the flat walls relatively away from each other to assist the cap in maintaining and recovering its normal configuration.

22. The pinch cap of claim 16 wherein the locking means includes a plurality of rib-like projections carried on the side wall portions.

23. The pinch cap of claim 22 wherein the rib-like projections include rib portions which extend substantially parallel to the plane of the flat top wall.

24. The pinch cap of claim 23 wherein the rib-like projections include tapered guide projections which connect with the rib portions and depend therefrom along the side wall portions in directions substantially transverse to the plane of the flat top wall.

25. The pinch cap of claim 22 wherein the rib-like projections include tapered rib portions which are inclined relative to the plane of the flat top wall.

26. The pinch cap of claim 25 wherein the tapered rib portions are located on the side wall portions in proximity to where the flat walls join the side wall portions.

27. The pinch cap of claim 16 additionally including grip-enhancing formation means provided on the relatively movable portions and facing into the finger-receiving wells to facilitate one's gripping the relatively movable portions.

28. The pinch cap of claim 16 additionally including rigidifying means connecting with the bottom walls and their associated side wall portions to rigidify the junctures between the bottom walls and the side wall portions.

29. The pinch cap of claim 16 additionally including vent formation means extending along the side wall portions and along the underside of the rim to vent gases through a container opening which is closed by the cap.

30. The pinch cap of claim 16 wherein the locking means includes:

(a) circumferentially-extending rib segments carried on the curved side wall portions and extending in a plane substantially paralleling that of the flat top wall; and, (b) guide formation means depending along the curved side wall portions from the rib segments for effecting deformation of the cap during insertion of the cap into a container opening to permit the rib segments to pass through the container opening.

* * * * *